US005272916A

United States Patent [19]

Blauch et al.

[11] Patent Number: 5,272,916

[45] Date of Patent: Dec. 28, 1993

[54] METHODS OF DETECTING AND MEASURING IN-SITU ELASTIC ANISOTROPY IN SUBTERRANEAN FORMATIONS

[75] Inventors: Matthew E. Blauch; Timothy R. Heemstra; James J. Venditto, all of Duncan, Okla.

[73] Assignee: Halliburton Company, Duncan, Okla.

[21] Appl. No.: 902,108

[22] Filed: Jun. 22, 1992

[51] Int. Cl.[5] ..... E21B 47/00

[52] U.S. Cl. ..... 73/151; 166/250

[58] Field of Search ..... 73/151, 783, 152, 784; 166/250

[56] References Cited

U.S. PATENT DOCUMENTS

| | | | |
|---|---|---|---|
| 3,796,091 | 3/1974 | Serata | 73/784 |
| 4,149,409 | 4/1979 | Serata | 73/151 |
| 4,461,171 | 7/1984 | de la Cruz | 73/151 |
| 4,529,036 | 7/1985 | Daneshy et al. | 166/254 |
| 4,673,890 | 6/1987 | Copland et al. | 33/178 F |
| 4,813,278 | 3/1989 | Kosugi | 73/783 |
| 4,899,320 | 2/1990 | Hearn et al. | 367/35 |

OTHER PUBLICATIONS

SPE 16526, "Modeling of the Stability of Highly Inclined Boreholes in Anisotropic Rock Formations"; Bernt S. Aadnoy, p. 263, SPE Drilling Engineering, Sep., 1988.

*Primary Examiner*—Robert J. Warden
*Assistant Examiner*—Krisanne M. Thornton
*Attorney, Agent, or Firm*—Robert A. Kent; C. Clark Dougherty, Jr.

[57] ABSTRACT

Methods of detecting and measuring in-situ elastic anisotropy in a subterranean rock formation penetrated by a well bore are provided. The methods basically include exerting pressure on the formation by way of the well bore, and measuring the incremental diametral displacements of the well bore at a location therein adjacent the formation as the pressure on the formation is increased. The magnitudes of the diametral displacements are compared to detect and measure elastic anisotropy in the formation.

19 Claims, 2 Drawing Sheets

METHODS OF DETECTING AND MEASURING IN-SITU ELASTIC ANISOTROPY IN SUBTERRANEAN FORMATIONS

BACKGROUND OF THE INVENTION

1. Field of the Invention

The present invention relates to methods of detecting and measuring in-situ elastic anisotropy in subterranean rock formations by sensing pressure induced well bore diametral displacements.

2. Description of the Prior Art

A commonly utilized technique for stimulating the production of hydrocarbons from a subterranean rock formation penetrated by a well bore is to create and extend fractures in the formation. Generally, the fractures are created by applying hydraulic pressure on the formation from the well bore. That is, a fracturing fluid is pumped through the well bore and into the formation at a rate and pressure such that the resultant hydraulic force exerted on the formation causes one or more fractures to be created therein. The fractures are extended by continued pumping, and the fractures can be propped open or flow channels can be etched in the faces of the fractures with acid or both to provide openings in the formation through which hydrocarbons readily flow to the well bore. Fracturing is also utilized in carrying out enhanced production procedures in subterranean formations as well as in other applications.

In designing fracturing treatments to be carried out in subterranean rock formations, it is often necessary and always desirable to know the direction in which fractures will extend in the formation and other directional fracture related characteristics such as in-situ rock elastic moduli, in-situ stresses, etc. Heretofore, the fracture direction and other subterranean rock formation characteristics have been determined or attempted to be determined by analyzing core samples from the formation. For example, U.S. Pat. No. 4,529,036 issued Jul. 16, 1985 to Daneshy et al. discloses a method of determining the orientation of a fracture or fractures created in a subterranean formation. In accordance with that method, the formation is hydraulically fractured at the lower end portion of the well bore and an azimuthally oriented core containing a portion of the fracture is removed from beneath the bottom of the well bore. An inspection of the core coupled with a knowledge of its orientation in the well bore are used to determine the direction of hydraulically induced fractures in the formation. While the method of Daneshy et al. has been utilized successfully for determining fracture direction, it is relatively time consuming and expensive as a result of the necessity of removing and testing a core, it does not provide other fracture related characteristics of the formation such as those described above and fracturing information is only obtainable at the conclusion of the test. Further, if the fracturing procedure is unsuccessful, the coring operation and the testing of the core are performed without knowledge of whether the core does or does not contain a fracture.

More recently, tools have been developed for measuring the in-situ enlargements of a well bore penetrating a subterranean formation in response to pressure exerted on the formation. Such a tool is described in U.S. Pat. No. 4,673,890 issued Jun. 16, 1987 to Copland et al. In the use of the tool, it is connected to a string of pipe and lowered in the well bore to a point adjacent a particular subterranean formation. The tool is isolated and locked in the well bore and increasing pressure is applied to the formation to a pressure level whereby the rock formation adjacent the tool fractures. As the pressure is being increased, the tool measures incremental diametral displacements of the well bore which are processed and recorded. The tool and the measurements are azimuthally oriented and the measurements are utilized to determine the direction of the fracture or fractures created in the formation.

By the present invention, a method is provided for using a tool such as the tool described in U.S. Pat. No. 4,673,890 to detect and measure in-situ elastic anisotropy in a subterranean rock formation in addition to determining fracture direction and fracture width as a function of time and pressure. The detection and measurement of elastic anisotropy allows the calculation of directional in-situ rock elastic moduli, the comparison of anisotropy to current in-situ stress direction and the investigation of potential anelastic formation anisotropies through pressure cycling. A comparison of the principal directions of the in-situ moduli with those of the in-situ stresses found from hydraulic fracture direction can provide insight into the history of the stress field. Such information is used for designing subsequent fracture treatments, for making realistic and accurate fracture models and for aiding in the understanding of the geology, geophysical characteristics and/or stress orientations of a region.

SUMMARY OF THE INVENTION

As mentioned above, the present invention provides methods of detecting and measuring in-situ elastic anisotropy in subterranean rock formations penetrated by well bores. The methods basically comprise the steps of increasing pressure on a subterranean formation by way of the well bore, measuring the diametral displacements of the well bore in three or more angularly offset directions at a location adjacent the formation as the pressure of the formation is increased and then comparing the magnitudes of the displacements to detect and measure elastic anisotropy in the formation.

The measurement of the in-situ elastic anisotropy in the form of directional diametral displacements at increments of pressure exerted on the formation are utilized to calculate directional elastic moduli in the rock formation and other factors relating to the mechanical behavior of the formation.

It is, therefore, a general object of the present invention to provide improved methods of detecting and measuring in-situ elastic anisotropy in subterranean rock formations.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

In carrying out the method of the present invention, a well bore is drilled into or through a subterranean formation in which it is desired to determine fracture related properties, e.g., the relationship between applied pressure and well bore deformation which allows the calculation of in-situ rock elastic moduli and in-situ stresses. A knowledge of such fracturing related properties of a rock formation as well as fracture direction and fracture width as a function of pressure prior to carrying out a fracture treatment in the formation allows the fracture treatment to be planned and performed very efficiently whereby desired results are obtained. In addition, knowing the fracture direction allows the optimum well spacing in a field to be determined as well as the establishment of the shape of the drainage area and the optimum placement of both vertical and horizontal wells.

Figure 1:
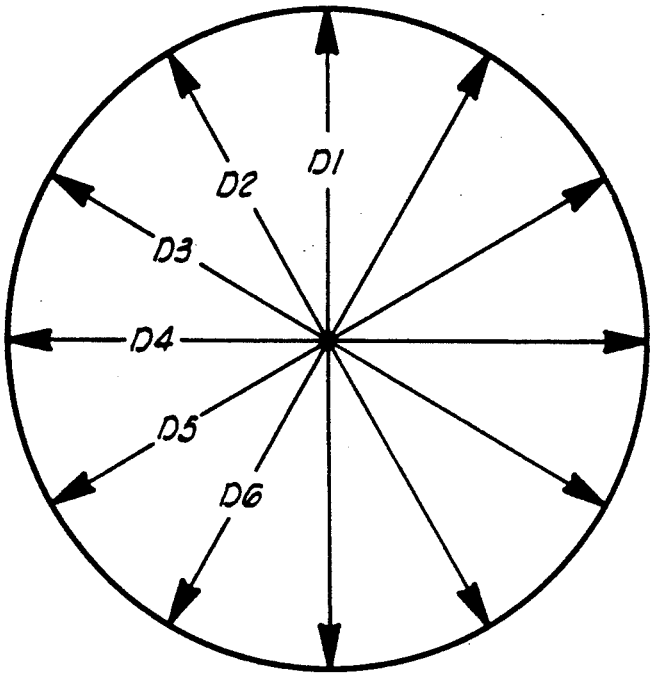
FIG. 1 represents a horizontal cross-section through a vertical well bore showing the angularly offset directions in which well bore diametral displacements are preferably measured.

Prior to casing or lining a well bore penetrating a formation to be tested, a measurement tool of the type described in U.S. Pat. No. 4,673,890 is lowered through the well bore to a point adjacent the formation in which fracture related properties are to be determined. The measurement tool includes packers whereby it can be isolated in the zone to be tested, and radially extendable arms are provided which engage the sides of the well bore and measure initial diameter and diametral displacements in at least three angularly offset directions. Preferably, the measurement tool includes six pairs of oppositely positioned radially extendable arms whereby diameters and diametral displacements are measured in six equally spaced angularly offset directions as shown in FIG. 1. The measurement tool must have sufficient sensitivity to measure incremental displacements in micro-inches.

After isolation and once the extendable arms are in firm contact with the walls of the well bore adjacent the formation to be tested, the tool continuously measures diametral displacements as the pressure exerted in the well bore is increased. Generally, the measurement tool is connected to a string of drill pipe or the like and after being lowered and isolated in the well bore adjacent the formation to be tested, the pipe and the portion of the well bore containing the measurement tool are filled with a fluid such as an aqueous liquid. The measurement tool then measures the initial diameters of the well bore in the angularly offset directions at the static liquid pressure exerted on the formation. The measurement tool is azimuthally orientated so that the individual polar directions of the measurements are known.

Figure 2:
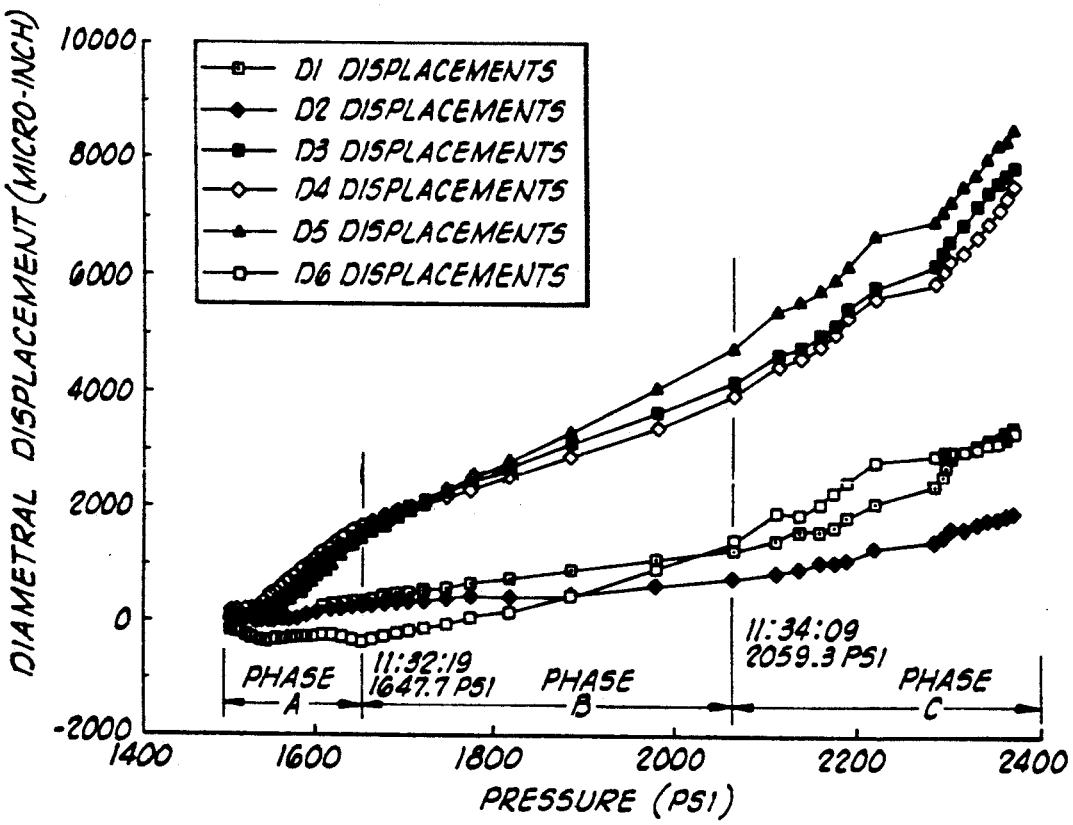
FIG. 2 is a graph showing the diametral displacements of a well bore versus pressure.

Additional fluid is pumped into the well bore thereby increasing the pressure exerted on the formation adjacent the measurement tool from the static fluid pressure to a pressure above the pressure at which one or more fractures are created in the formation. As the pressure is increased, the directional diametral displacements of the well bore are measured at a minimum of two and preferably at a plurality of pressure increments. For example, the directional diametral measurements can be simultaneously made once each second during the time period over which the pressure is increased. The measurements are recorded and processed electronically whereby the magnitudes of the diametral displacements in the various directions can be compared, e.g., graphically as shown in FIG. 2. In-situ elastic anisotropy in the formation is shown if the magnitudes of the diametral displacements are unequal. Thus, the measurements are used to detect whether or not the rock formation being tested is in a state of elastic anisotropy, and the measurement data corresponding to pressure exerted on the formation is utilized to calculate in-situ rock moduli and other rock properties relating to fracturing. When the formation fractures, the measurement data at the time of the fracture and thereafter is utilized to determine fracture direction and fracture width as a function of time and pressure.

Thus, the method of the present invention basically comprises the steps of exerting increasing pressure on a formation by way of the well bore, measuring the diametral displacements of the well bore in three or more angularly offset directions at a location adjacent the formation as the pressure on the formation is increased, and then comparing the magnitudes of the diametral displacements to determine if they are unequal and to thereby detect and measure elastic anisotropy in the formation.

The angularly offset directions are azimuthally oriented, and the incremental diametral displacements are preferably measured in a plurality of equally spaced angularly offset directions. Once the azimuthal orientation of formation anisotropy is known, the tool may be reoriented for the purpose of directly measuring maximum and minimum displacement aligned in the inferred plane of minimum and maximum stress.

When the in-situ elastic anisotropy of a subterranean formation has been detected and measured as described above, directional elastic moduli, i.e., Young's modulus and/or shear modulus are determined using the pressure correlated displacement data obtained. That is, the Young's modulus of the formation in each direction is determined using the following formula:

$$E = \frac{(P_2 - P_1)D}{(W_2 - W_1)}(1 + \mu)$$

wherein

E represents Young's Modulus;

$P_1$ represents a first pressure;

$P_2$ represents a second greater pressure;

D represents the initial well bore diameter;

$W_1$ represents the diametral displacement of the well bore at the first pressure ($P_1$);

$W_2$ represents the well bore diametral displacement at the second pressure ($P_2$); and $\mu$ represents Poisson's Ratio.

Young's modulus values obtained in accordance with this invention using the above formula are close approximations of the actual Young's modulus values of the tested formation in the directions of the well bore measurements.

Young's modulus can be defined as the ratio of normal stress to the resulting strain in the direction of the applied stress, and is applicable for the linear range of the material; that is, where the ratio is a constant. In an anisotropic material, Young's modulus may vary with direction. In subterranean formations, the plane of applied stress is usually defined in the horizontal plane which is roughly parallel to bedding planes in rock strata where the bedding is horizontally aligned.

Poisson's ratio ($\mu$) can be defined as the ratio of lateral strain (contraction) to the axial strain (extension) for normal stress within the elastic limit.

Young's modulus is related to shear modulus by the formula:

$$E=2G(1+\mu)$$

wherein:

E represents Young's modulus;

G represents shear modulus; and $\mu$ represents Poisson's Ratio.

Shear modulus can be defined as the ratio of shear stress to the resulting shear strain over the linear range of the material.

Thus, once the approximate Young's modulus in a direction is calculated, shear modulus can also be calculated. Both shear modulus and Young's modulus are based on the elasticity of rock theory and are utilized to calculate various rock properties relating to fracturing as is well known by those skilled in the art. The term stress, as it is used here can be defined as the internal force per unit of cross-sectional area on which the force acts. It can be resolved into normal and shear components which are perpendicular and parallel, respectively, to the area. Strain, as it is used herein, can be defined as the deformation per unit length and is also known as "unit deformation". Shear strain can be defined as the lateral deformation per unit length and is also known as "unit detrusion". The term "elastic moduli" is sometimes utilized herein to refer to both shear modulus and Young's modulus. The directional diametral displacement and elastic moduli data obtained in accordance with this invention can be utilized to verify in-situ stress orientation, verify or predict hydraulic fracture direction in the formation and to design subsequent fracture treatments using techniques well known to those skilled in the art.

A particularly preferred method of the present invention for detecting and measuring in-situ elastic anisotropy in a subterranean rock formation penetrated by a well bore comprises the steps of:

(a) placing a well bore diameter and diametral displacement measurement tool in the well bore adjacent the formation, the tool being capable of measuring well bore initial diameters and diametral displacements in a plurality of azimuthally oriented angularly offset directions at an initial pressure and at two or more successive pressure increments;

(b) exerting initial pressure on the formation by way of the well bore;

(c) increasing the pressure exerted on the formation;

(d) measuring the diameters at the initial pressure and the diametral displacements at the two or more successive pressure increments in each of the azimuthally oriented angularly offset directions;

(e) comparing the magnitudes of the diametral displacements to determine if they are unequal to thereby detect and measure in-situ elastic anisotropy in the formation; and (f) determining the approximate in-situ Young's modulus of the rock formation in each of the directions by multiplying the difference in pressure between two of the pressure increments by the initial diameter of the well bore and by 1 plus Poisson's ratio and dividing the product obtained by the difference between the diametral displacements at the pressure increments.

In order to further illustrate the methods of the present invention the following example is given.

EXAMPLE

A well bore measurement tool of the type described in U.S. Pat. No. 4,673,890 was used to test a subterranean formation. The measurement tool, connected to a string of tubing, was lowered to a location in the well bore adjacent the formation to be tested that had been cored to a diameter of 7⅞", and the measurement tool was isolated by setting top and bottom packers. The string of tubing was filled with an aqueous liquid and the annulus between the tubing and the walls of the well bore was pressured with nitrogen gas.

The measurement tool included six pairs of opposing radially extendable arms whereby initial diameters and diametral displacements were measured in a substantially horizontal plane in six angularly offset directions designated D1 through D6 as shown in FIG. 1. After the arms were extended and stabilized against the walls of the well bore, the measurement tool was activated. Measurements were made and processed as the liquid pressure exerted on the formation was increased from the initial static liquid pressure by pumping additional liquid through the tubing against and into the tested formation at a rate of 3 gallons per minute.

The diametral displacement measurements made by the measurement tool while the pressure was increased from about 1490 psi (static liquid pressure) to about 2380 psi are presented graphically in FIG. 2. As shown, the diametral displacements are not equal thereby indicating elastic anisotropy. The data presented in FIG. 2 covers the period from the start of pumping 11:21:35 a.m. to fracture initiation at 11:37:19 a.m. During that period, the testing went through three distinct phases indicated in FIG. 2 by the letters A, B and C. In phase A, the measured displacements were not linear and remained substantially constant in the directions D1, D2 and D6 indicating a hard quadrant while D3, D4 and D5 changed dramatically indicating a soft quadrant. The cause for the non-linearity is speculated to be movements associated with further seating of the arms and/or the closing of micro fractures in the formation. At a pressure of about 1647.7 psi and time of 11:32:19 a.m., the early non-linearity came to an end, and a second phase (phase B) began during which the diametral displacements were generally linear. Phase B continued to the time of 11:34:09 a.m. and a pressure of 2059.3 psi whereupon the fracturing phase (phase C) began and the displacements again became non-linear.

When a fracture was induced at 11:37:19 a.m. there was a sudden change in the readings and shifting of the instrument. Prior to the shifting, seven one second diametral displacement readings were obtained from which the width of the induced fracture (the displacement in a direction perpendicular to the fracture direction) was determined to be approximately 0.027 inches and the fracture direction was determined to be N 67° E (magnetic).

The directional stress moduli of the test formation were calculated using the linear displacement data obtained during phase B of the test period shown in FIG. 2. The calculations were made using the formulae set forth above, and the results are as follows:

| Direction | $W_1$, μ-inches | $W_2$, μ-inches | $W_2 - W_1$, μ-inches | E, $10^6$ psi |
|---|---|---|---|---|
| D1 | 343 | 1244 | 901 | 4.50 |
| D2 | 267 | 701 | 434 | 9.34 |
| D3 | 1670 | 4112 | 2442 | 1.66 |
| D4 | 1603 | 3882 | 2279 | 1.78 |
| D5 | 1508 | 4697 | 3189 | 1.27 |
| D6 | −350 | 1375 | 1725 | 2.35 |

From the values set forth above, it can be seen that the smallest difference between and $W_2$ and $W_1$ took place in the direction D2 and the calculated shear modulus is greatest in the direction D2. In this example, the fracture direction also corresponded to D2.

Figure 3:
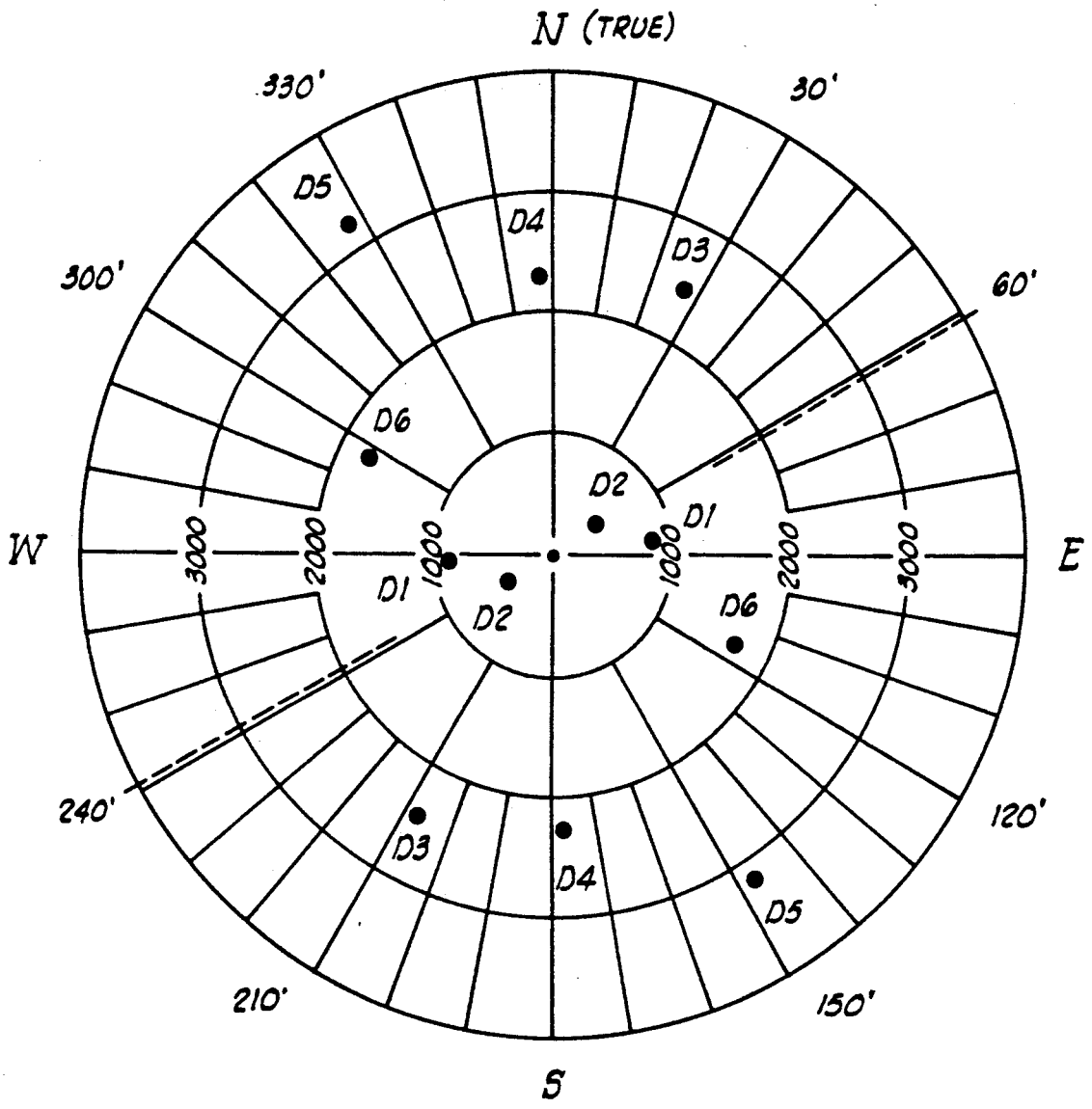
FIG. 3 is a polar graph showing the diametral enlargements of a well bore as a result of the pressure increase over the time period identified as phase B in FIG. 2.

Referring now to FIG. 3, a polar plot of the differences in displacements ($W_2$—$W_1$) in μ-inches for D1 through D6 is presented, and the fracture direction indicated by the measuring tool of N 67° E is shown in dashed lines thereon. As shown in FIG. 3, the actual fracture direction substantially corresponds with the direction D2 in which the least well bore diametral displacement difference took place and in which direction the formation had the highest elastic moduli.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of detecting and measuring in-situ elastic anisotropy in a subterranean rock formation penetrated by a well bore comprising the steps of:

exerting increasing fluid pressure on said formation from an initial pressure by way of said well bore;

measuring the incremental diametral displacements of said well bore in at least three angularly offset directions at a location in said well bore adjacent said formation as said pressure on said formation is increased; and comparing the magnitudes of said diametral displacements to thereby detect and measure elastic anisotropy in said formation.

2. The method of claim 1 wherein said angularly offset directions are azimuthally oriented.

3. The method of claim 2 wherein said incremental diametral displacements of said well bore are simultaneously measured in a plurality of angularly offset directions.

4. The method of claim 2 wherein said diametral displacements are measured a first pressure greater than said initial pressure and at a second pressure greater than said first pressure.

5. The method of claim 4 which further comprises determining the approximate in-situ Young's modulus of said rock formation in each of said directions by multiplying the difference between said second pressure and said first pressure by the diameter of said well bore at said initial pressure and by 1 plus Poisson's ratio and dividing the product obtained by the difference between the diametral displacements measured at said second pressure and said first pressure for each of said directions.

6. The method of claim 3 wherein said incremental diametral displacements are measured in six angularly offset directions.

7. A method of detecting and measuring in-situ elastic anisotropy in a subterranean rock formation penetrated by a well bore comprising the steps of:

(a) placing a well bore diameter and diametral displacement measurement tool in said well bore adjacent said formation, said tool being capable of simultaneously measuring well bore initial diameters and diametral displacements in a plurality of azimuthally oriented angularly offset directions at an initial fluid pressure and at a first pressure and at a second pressure greater than said initial fluid pressure;

(b) exerting said initial fluid pressure on said formation by way of said well bore;

(c) increasing said fluid pressure exerted on said formation;

(d) measuring said initial diameters at said initial fluid pressure and said diametral displacements at said first pressure and at said second pressure in each of said azimuthally oriented angularly offset directions; and (e) comparing the magnitudes of said diametral displacements to thereby detect and measure elastic anisotropy in said formation.

8. The method of claim 7 which further comprises determining the approximate in-situ Young's modulus of said rock formation in each of said directions by multiplying the difference in pressure between said second pressure and said first pressure by the diameter of said well bore at said initial fluid pressure and by 1 plus Poisson's ratio and dividing the product obtained by the difference between the diametral displacements measured at said second pressure and at said first pressure.

9. The method of claim 7 wherein said diametral displacements are measured in accordance with step (d) in six angularly offset directions.

10. The method of claim 7 wherein said initial pressure exerted on said formation in accordance with step (a) is the static pressure exerted by a column of fluid contained in said well bore.

11. The method of claim 10 wherein said pressure is increased in accordance with step (c) by pumping additional fluid into said well bore.

12. The method of claim 1 wherein a time period elapses between each of said measurements made in accordance with step (d) and said time period is about one second.

13. The method of claim 7 wherein said pressure is increased in accordance with step (c) until said formation is caused to fracture.

14. A method of detecting said measuring in-situ elastic anisotropy in a subterranean rock formation penetrated by a well bore comprising the steps of:

(a) placing a well bore diameter and diametral displacement measurement tool in said well bore adjacent said formation, said tool having sufficient measurement sensitivity to measure well bore initial diameters and diametral displacements in a plurality of azimuthally oriented angularly offset directions at an initial pressure and at successive pressures greater than said initial pressure;

(b) filling a portion of said well bore with a liquid whereby an initial static liquid pressure is exerted on said formation;

(c) increasing said pressure exerted on said formation by pumping additional liquid into said well bore;

(d) measuring said initial diameters at said initial pressure and said diametral displacements at successive pressures greater than said initial pressure in each of said azimuthally oriented angularly offset direction;

(e) comparing the magnitudes of said diametral displacements to thereby detect and measure elastic anisotropy in said formation; and (f) determining the approximate in-situ shear modulus of said rock formation in each of said directions by multiplying the difference between two of said successive pressures greater than said initial pressure by the diameter of said well bore at said initial pressure and by 1 plus Poisson's ratio and dividing the product obtained by the difference between the diametral displacements at said successive pressure.

15. The method of claim 14 wherein said liquid is an aqueous liquid.

16. The method of claim 14 wherein said diametral displacements are measured in six angularly offset directions.

17. The method of claim 16 wherein said angularly offset directions are equally spaced over 360°.

18. The method of claim 14 wherein a time period elapses between said measurements and said time period is about one second.

19. The method of claim 18 wherein said pressure is increased in accordance with step (c) until said formation is caused to fracture.

* * * * *